US009633762B2

(12) United States Patent
Nagashima

(10) Patent No.: US 9,633,762 B2
(45) Date of Patent: Apr. 25, 2017

(54) CABLE

(71) Applicant: Yazaki Corporation, Tokyo (JP)

(72) Inventor: Yoshikazu Nagashima, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 21 days.

(21) Appl. No.: 14/744,152

(22) Filed: Jun. 19, 2015

(65) Prior Publication Data

US 2015/0287499 A1 Oct. 8, 2015

Related U.S. Application Data

(63) Continuation of application No. PCT/JP2013/084505, filed on Dec. 24, 2013.

(30) Foreign Application Priority Data

Dec. 27, 2012 (JP) ..... 2012-285478

(51) Int. Cl.
*H01B 11/04* (2006.01)
*H01B 7/30* (2006.01)

(52) U.S. Cl.
CPC ..... *H01B 7/30* (2013.01)

(58) Field of Classification Search
CPC ..... H01B 11/04
USPC ..... 174/113 R, 74 R, 32, 33
See application file for complete search history.

(56) References Cited

U.S. PATENT DOCUMENTS 5,316,506 A * 5/1994 Ito ..... H01R 4/188 174/94 R
5,777,273 A 7/1998 Woody et al.
5,966,056 A * 10/1999 Thornton ..... H04L 5/20 174/32
6,215,062 B1 * 4/2001 Kimber ..... H01B 11/005 174/113 R
6,225,565 B1 * 5/2001 Prysner ..... H01B 9/027 174/120 SC
6,290,532 B1 * 9/2001 Vermeersch ..... H05K 3/301 439/460
8,692,113 B2 * 4/2014 Huang ..... H01R 4/185 174/113 R (Continued)

FOREIGN PATENT DOCUMENTS

JP 62157530 A 7/1987
JP 62157531 A 7/1987

(Continued)

OTHER PUBLICATIONS

Communication dated Jun. 15, 2016 issued by the European Patent Office in counterpart application No. 13869193.6.

(Continued)

*Primary Examiner* — Chau N Nguyen
(74) *Attorney, Agent, or Firm* — Sughrue Mion, PLLC

(57) ABSTRACT

Provided is a cable enabling to reduce leakage flux and to restrict an increase of high-frequency resistance. A magnetic shield is provided to enable to reduce leakage of magnetic flux to an outside, and two first conductive wires and two second conductive wires having different phases from each other are adjacent to each other and arranged annularly to enable to disperse the magnetic flux, to restrict a proximity effect, and to restrict an increase of high-frequency resistance.

2 Claims, 4 Drawing Sheets

(56) References Cited

U.S. PATENT DOCUMENTS

| | | | | |
|---|---|---|---|---|
| 8,723,029 | B2 * | 5/2014 | Pyczak | H01R 9/03 174/113 R |
| 2001/0002773 | A1 | 6/2001 | Hyogo | |
| 2013/0118798 | A1 | 5/2013 | Hiraike et al. | |

FOREIGN PATENT DOCUMENTS

| | | | |
|---|---|---|---|
| JP | 62-190611 | A | 8/1987 |
| JP | 1126458 | A | 5/1989 |
| JP | 4215213 | A | 8/1992 |
| JP | 9-180550 | A | 7/1997 |
| JP | 10-116519 | A | 5/1998 |
| JP | 2004-235112 | A | 8/2004 |
| JP | 2012-150980 | A | 8/2012 |
| JP | 2013-122911 | A | 6/2013 |
| WO | 2011/011776 | A1 | 1/2011 |
| WO | 2011/024262 | A1 | 3/2011 |

OTHER PUBLICATIONS

International Search Report of PCT/JP2013/084505 dated Feb. 10, 2014 [PCT/ISA/210].

Written Opinion for PCT/JP2013/084505 dated Feb. 10, 2014 [PCT/ISA/237].

Communication dated Nov. 22, 2016, from the Japanese Patent Office in counterpart application No. 2012-285478.

Communication dated Sep. 13, 2016, from the Japanese Patent Office in counterpart application No. 2012-285478.

* cited by examiner

CABLE

TECHNICAL FIELD

The present invention relates to a cable for high-frequency alternating-current power transmission.

BACKGROUND ART

Conventionally, as a cable for high-frequency alternating-current power transmission, one including a magnetic shield is proposed (e.g., refer to Patent Literature 1). In the cable described in Patent Literature 1, an outside of a pair of electric wires having different phases from each other is covered with a magnetic shield to reduce leakage flux, which is particularly problematic at the time of transmission of high-frequency alternating-current power.

CITATION LIST

Patent Literature

Patent Literature 1: JP 10-116519 A

SUMMARY OF INVENTION

Technical Problem

However, in the cable described in Patent Literature 1, providing a magnetic shield 104 causes magnetic flux B to concentrate between an electric wire 102 and an electric wire 103 as illustrated in FIG. 4A, which causes a problem in which a cross-sectional area of a region V easily carrying current is smaller than in a configuration of providing no magnetic shield illustrated in FIG. 4B due to a proximity effect, and in which high-frequency resistance increases.

An object of the present invention is to provide a cable enabling to reduce leakage flux and to restrict an increase of high-frequency resistance.

Solution to Problem

A cable according to the present invention is a cable provided with a magnetic shield and having a pair of electric wires transmitting alternating-current power and includes a first electric wire as a first side of the pair of electric wires having a plurality of first conductive wires and a second electric wire as a second side of the pair of electric wires having a plurality of second conductive wires. The first conductive wires and the second conductive wires are arranged alternately and disposed annularly in a circumferential direction of the cable.

According to the present invention described above, by providing the magnetic shield, leakage flux is reduced. Also, by alternately arranging the first conductive wires and the second conductive wires having different phases from each other, each of the conductive wires is adjacent to two conductive wires having the other phase. Accordingly, concentration of magnetic flux is prevented further, and a proximity effect is restricted further than in a configuration in which each of the conductive wires is adjacent to one conductive wire having the other phase.

At this time, in the cable according to the present invention, each of the number of the first conductive wires and the number of the second conductive wires is preferably two.

According to this configuration, since a cross-sectional area of a space surrounded by the conductive wires disposed annularly is minimum, an occupancy ratio of the electric wires in a cross-sectional area of the entire cable is higher, and an outside diameter of the cable can be shortened while securing the cross-sectional area of the electric wires. Also, a configuration in which each of the conductive wires is adjacent to two conductive wires having the other phase can be simplified most.

Also, in the cable according to the present invention, an end portion of the first electric wire is preferably provided with a first terminal having a first terminal surface parallel to an opposing direction of the first conductive wires and an axial direction of the cable, an end portion of the second electric wire is preferably provided with a second terminal having a second terminal surface parallel to the first terminal surface, the two first conductive wires preferably extend in the axial direction and are collectively connected to the first terminal, and the two second conductive wires are preferably bent in a plane parallel to the second terminal surface, extend in the axial direction to avoid interference with the first terminal, and are collectively connected to the second terminal.

According to this configuration, since the first terminal surface and the second terminal surface are parallel to each other, a connecting structure to an outside can be simplified. Also, since the first conductive wires extend linearly in the axial direction and are connected to the first terminal, the two first conductive wires can have equal length dimensions. Also, since the second conductive wires are bent in the plane parallel to the second terminal surface and extend in the axial direction, the two second conductive wires can have equal length dimensions. Circulating current is prevented from being generated respectively in the first electric wire and the second electric wire. At this time, a difference of the length dimensions between each first conductive wire and each second conductive wire having different phases from each other does not contribute to circulating current.

Furthermore, in the cable according to the present invention, a circumference of each of the first conductive wires and the second conductive wires is preferably provided with an insulating cover.

According to this configuration, since the insulating cover secures a distance between each first conductive wire and each second conductive wire, insulation between the conductive wires can be secured, and concentration of magnetic flux can further be restricted.

Advantageous Effects of Invention

With the above cable according to the present invention, a magnetic shield is provided to enable to reduce leakage flux, and magnetic flux is dispersed, and a proximity effect is restricted to enable to prevent an increase of high-frequency resistance.

DESCRIPTION OF EMBODIMENTS

Hereinbelow, embodiments of the present invention will be described based on the drawings.

Figure 1A:
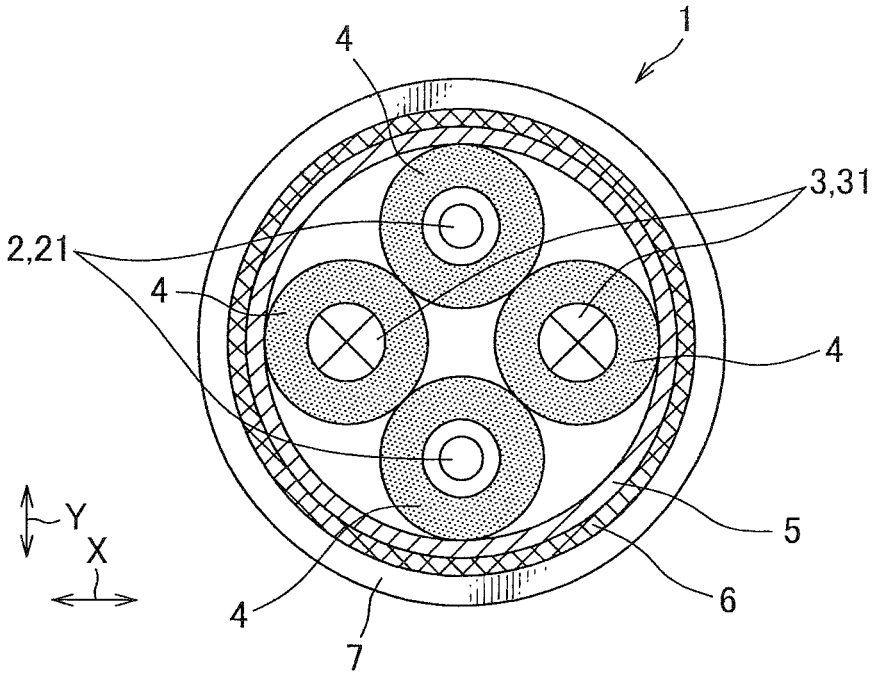
FIG. 1A is a cross-sectional view illustrating a cable according to an embodiment of the present invention.
Figure 1B:
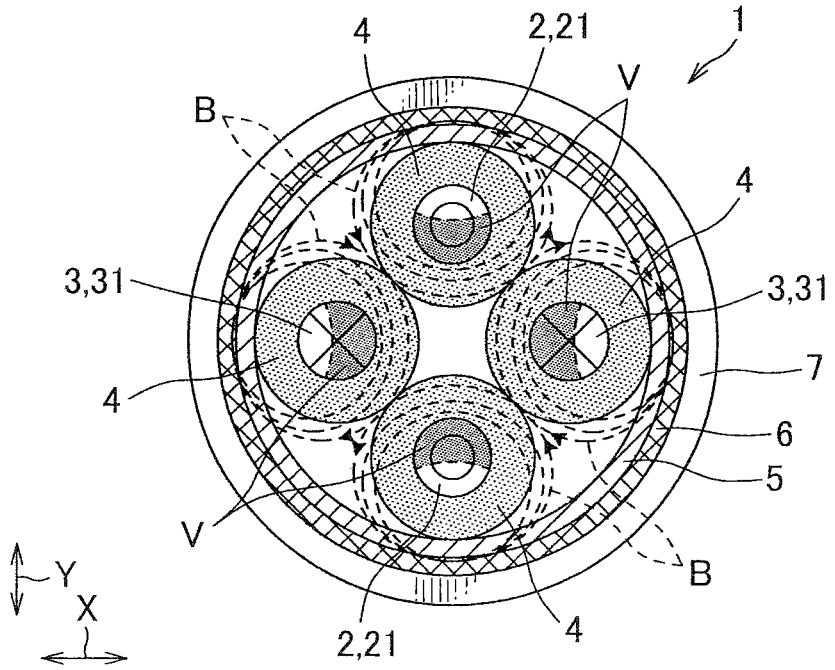
FIG. 1B is a cross-sectional view illustrating magnetic flux thereof.
Figure 2A:
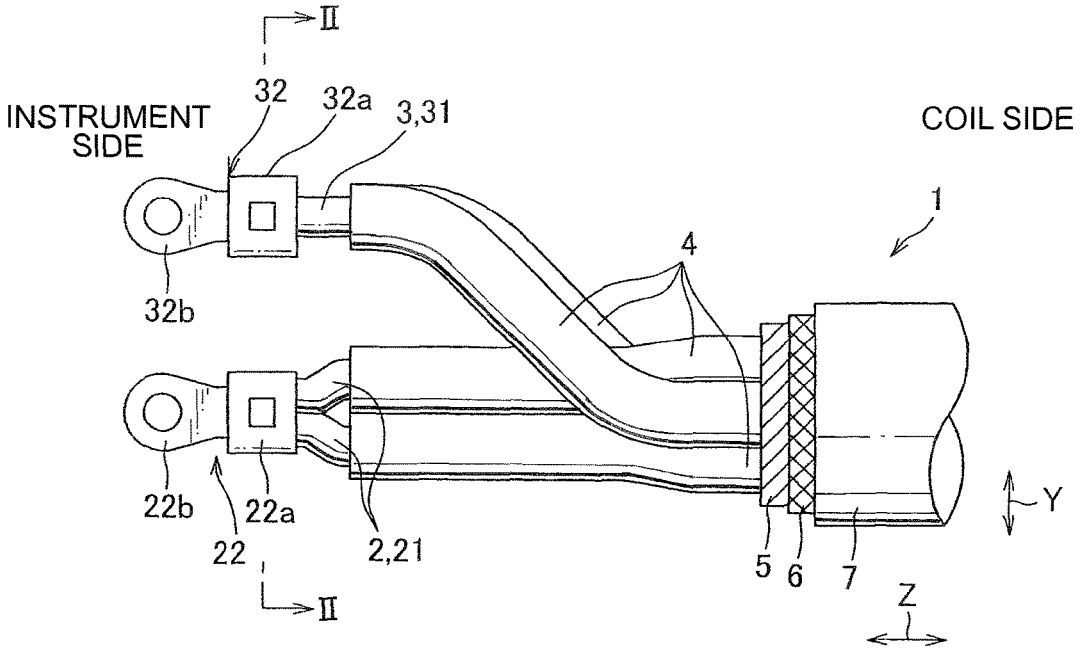
FIG. 2A is a side view illustrating a terminal structure of the cable.
Figure 2B:
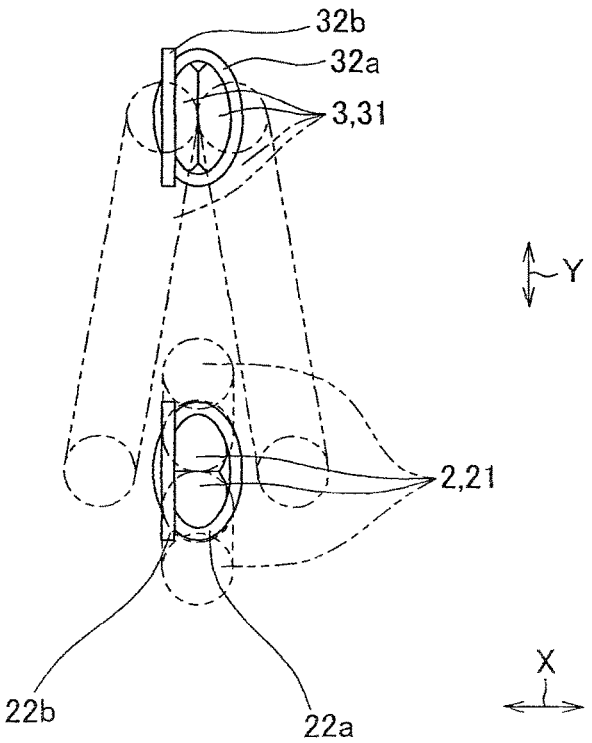
FIG. 2B is a cross-sectional view.
Figure 3:
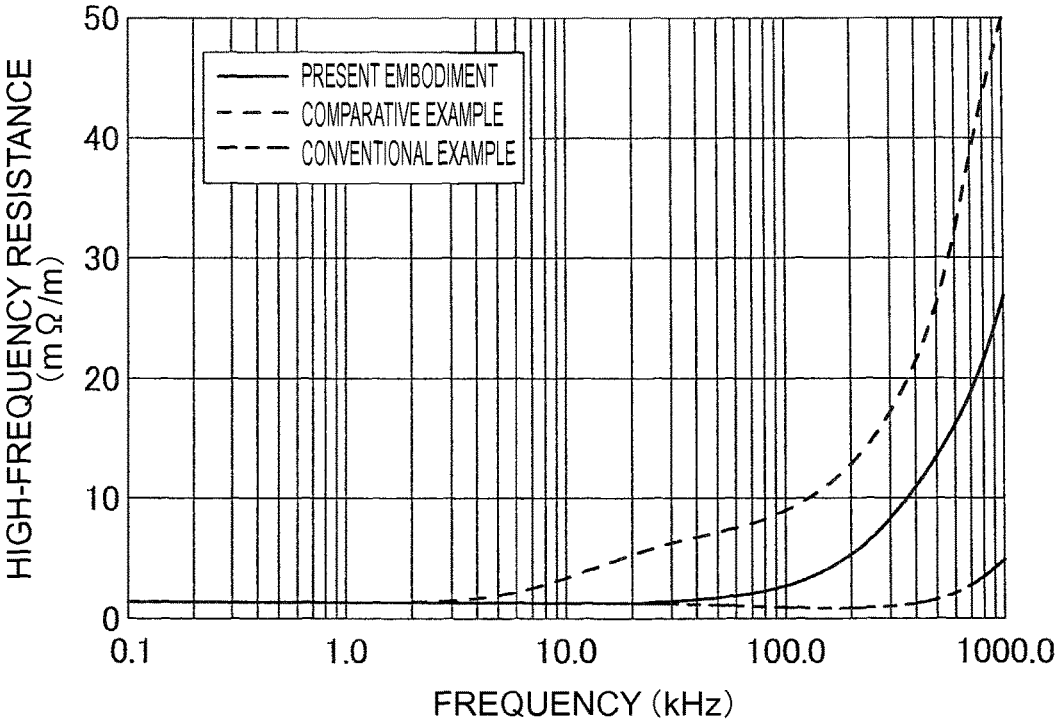
FIG. 3 is a graph illustrating frequency dependence of high-frequency resistance of the cable and conventional cables.
Figure 4A:
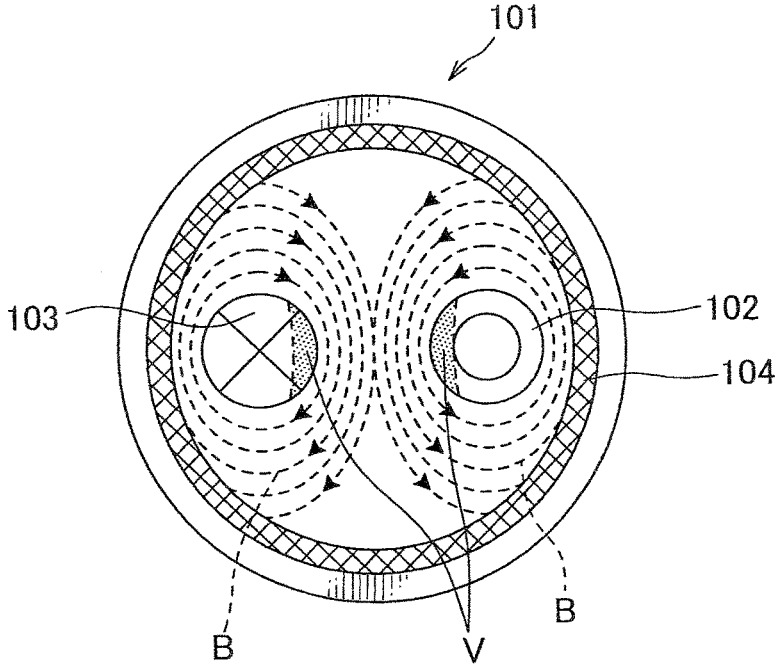
FIG. 4A PRIOR ART
FIGS. 4A and 4B are cross-sectional views illustrating the conventional cables.
Figure 4B:
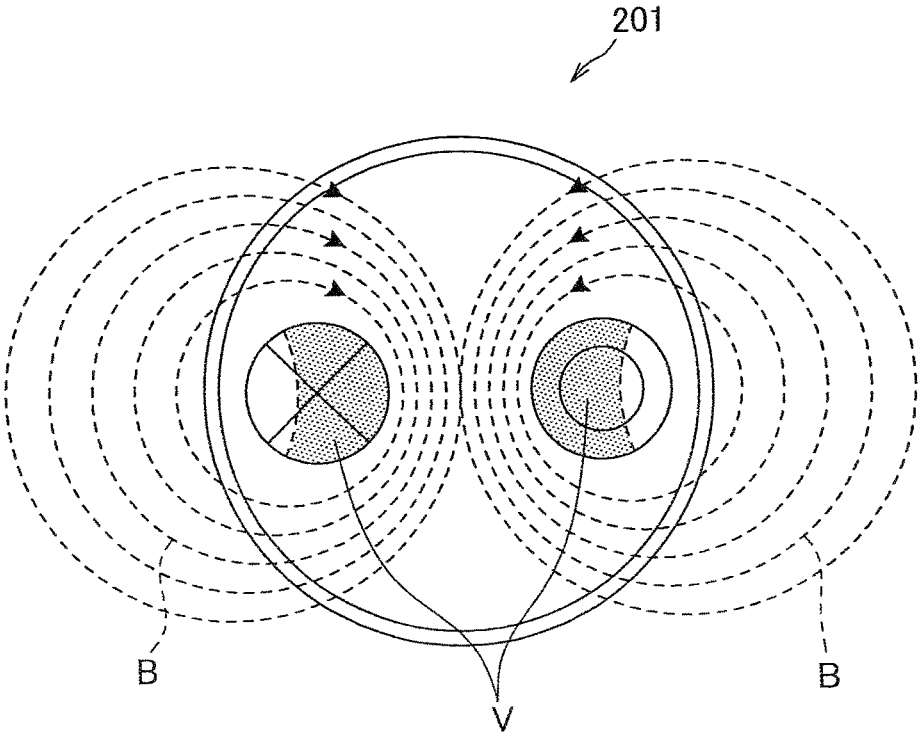
FIG. 4B PRIOR ART

FIGS. 1A and 1B are cross-sectional views illustrating a cable 1 according to an embodiment of the present invention. FIGS. 2A and 2B illustrate a terminal structure of the cable 1. FIG. 2A is a side view while FIG. 2B is a II-II cross-sectional view. FIG. 3 is a graph illustrating frequency dependence of high-frequency resistance of the cable 1 and conventional cables. FIGS. 4A and 4B are cross-sectional views illustrating the conventional cables. Although current and a direction of magnetic flux at a certain instant are illustrated in each of FIGS. 1A, 1B, 4A, and 4B, the direction and magnitude shall change every second since current is alternating in the present embodiment.

In FIGS. 1A to 2B, the cable 1 is a cable connecting an instrument such as a power supply device and a matching unit to a coil for wireless power feeding to transmit high-frequency alternating-current power and is configured to include a first electric wire 2 as a electric wire connecting one side of the instrument to one side of the coil, a second electric wire 3 as a electric wire connecting the other side of the instrument to the other side of the coil, an insulating cover 4 covering a first conductive wire 21 and a second conductive wire 31 respectively constituting the first electric wire 2 and the second electric wire 3, an inner sheath 5 bundling the first electric wire 2 and the second electric wire 3, a magnetic shield 6 provided outside the inner sheath 5, and an outer sheath 7 provided outside the magnetic shield 6.

Here, in the present embodiment, a right-left direction in FIGS. 1A and 1B is referred to as an X direction, an up-down direction in FIGS. 1A and 1B is referred to as a Y direction, and a right-left direction in FIG. 2A (an axial direction of the cable) is referred to as a Z direction. Also, a left side in FIG. 2A (a side connected to the instrument) is referred to as a Z-direction instrument side while a right side (a side connected to the coil) is referred to as a Z-direction coil side.

The first electric wire 2 is configured to include the two first conductive wires 21 and a first terminal 22 to which the two first conductive wires 21 are connected at an end portion on the Z-direction instrument side. Each of the first conductive wires 21 is a litz wire for reduction of high-frequency resistance, for example.

The second electric wire 3 is configured to include the two second conductive wires 31 and a second terminal 32 to which the second conductive wires 31 are connected at an end portion on the Z-direction instrument side. Each of the second conductive wires 31 is a litz wire for reduction of high-frequency resistance, for example.

As for the insulating cover 4, a thickness in a radial direction is set to enable to withstand voltage between wires, and the covers covering the adjacent conductive wires abut on each other.

The inner sheath 5 is made of resin, forms the cable to have a circular cross-section to keep positional relationship among the first conductive wires 21 and the second conductive wires 31 covered with the insulating covers 4, and is provided to secure a predetermined separation dimension between each of the conductive wires 21 and 31 and the magnetic shield 6.

The magnetic shield 6 is made of a material with high magnetic permeability and covers a circumference of the inner sheath 5. When current flows in the first conductive wires 21 and the second conductive wires 31 to cause a magnetic field to be generated, magnetic flux B preferentially passes through the magnetic shield 6 to prevent the magnetic flux B from leaking outside.

The outer sheath 7 is made of resin and covers an outside of the magnetic shield 6 to protect the cable 1 from external mechanical impact and the like.

Next, the positional relationship among the first conductive wires 21 and the second conductive wires 31 and flow of the magnetic flux B will be described.

As illustrated in FIGS. 1A and 1B, the two first conductive wires 21 are arranged in the Y direction while the two second conductive wires 31 are arranged in the X direction. That is, the first conductive wires 21 and the second conductive wires 31 are arranged alternately and disposed annularly. In such arrangement, at a moment at which positive current flows toward a front side of the drawing sheet in the Z direction in the first conductive wires 21 and at which positive current flows toward a rear side of the drawing sheet in the Z direction in the second conductive wires 31, the magnetic flux B flowing inside the cable 1 is as illustrated in FIG. 1B. That is, the magnetic flux B passes inside the magnetic shield 6 on an outer side in a radial direction of each of the conductive wires 21 and 31 and concentrates between the adjacent conductive wires.

Next, configurations of the first electric wire 2 and the second electric wire 3 at the end portions on the Z-direction instrument side will be described.

As illustrated in FIGS. 2A and 2B, the first conductive wires 21 extend toward the Z-direction instrument side, get closer to each other, and are connected to a swage portion 22*a* of the first terminal 22. At this time, the first conductive wires 21 have a mutual opposing direction thereof directed in the Y direction and have approximately equal length dimensions. On the other hand, the second conductive wires 31 are bent in a YZ plane (bent to an upper side in the Y direction in FIG. 2A), extend toward the Z-direction instrument side, get closer to each other, and are connected to a swage portion 32*a* of the second terminal 32. At this time, the second conductive wires 31 have a mutual opposing direction thereof directed in the X direction and have approximately equal length dimensions. Furthermore, a first terminal surface 22*b* and a second terminal surface 32*b* as connection parts to outsides in the first terminal 22 and the second terminal 32 are arranged in an approximately equal plane approximately parallel to the YZ plane and at approximately equal positions in the Z direction.

The present embodiment exerts the following effects.

That is, since the magnetic flux B flowing inside the cable 1 when current flows in the first electric wire 2 and the second electric wire 3 concentrates on both the adjacent sides of each of the conductive wires 21 and 31, a cross-sectional area of a region V easily carrying current is larger, and high-frequency resistance decreases further than in a comparative example illustrated in FIG. 4A, in which the single first electric wire 102 and the single second electric wire 103 are provided. At this time, frequency dependence characteristics of high-frequency resistance of a cable 201 according to a conventional example provided with no magnetic shield 6 illustrated in FIG. 4B, a cable 101 according to the comparative example, and the cable 1 according to the present embodiment are ones represented by a dashed-dotted line, a dashed line, and a solid line in FIG. 3, respectively. The high-frequency resistance in the present embodiment is higher than that in the conventional example but is lower than that in the comparative example at frequency of approximately 30 kHz or higher. In particular, at 20 to 200 kHz, which is used for wireless power feeding, the high-frequency resistance in the present embodiment is much better than that in the comparative example. Also, the magnetic flux B preferentially passes through the magnetic shield 6 to prevent the magnetic flux B from leaking outside.

Also, respectively providing the two first conductive wires 21 and the two second conductive wires 31 enables a cross-sectional area of a space surrounded by the conductive wires disposed annularly to be minimum. Also, a configuration in which each of the conductive wires 21 and 31 is adjacent to two conductive wires having the other phase can be simplified most.

Furthermore, arranging the first terminal surface 22*b* and the second terminal surface 32*b* in the approximately equal plane approximately parallel to the YZ plane and at the approximately equal positions in the Z direction simplifies a connecting structure to the instrument. At this time, since the two first conductive wires 21 as well as the two second conductive wires 31 have the approximately equal length dimensions, circulating current is prevented from flowing respectively in the first electric wire 2 and the second electric wire 3.

It is to be noted that the present invention is not limited to the above embodiment, includes other configurations and the like that can achieve the object of the present invention, and includes the following modifications.

For example, although the first electric wire 2 and the second electric wire 3 respectively have the two first conductive wires 21 and the two second conductive wires 31 in the above embodiment, the first electric wire 2 and the second electric wire 3 may respectively have the three or more ones so that the numbers thereof may be equal. In the case in which the numbers increase, the cross-sectional area of the aforementioned space is larger, and this space can be provided with a coaxial cable for signal transmission and reception, for example.

Also, although the first terminal 22 and the second terminal 32 are provided on the Z-direction instrument side in the above embodiment, these components can be omitted. The conductive wires may be connected to an instrument provided with as many connection parts as the number of the conductive wires, and the conductive wires having the same phases may be electrically connected inside the instrument. Alternatively, the first terminal 22 and the second terminal 32 may be provided at both end portions in the Z direction. According to this configuration, not only the coil and the instrument but also two instruments can be connected to each other, and high-frequency alternating-current power can be transmitted.

Also, although the circumference of each of the conductive wires 21 and 31 is covered with the insulating cover 4 in the above embodiment, an inside of the inner sheath 5 may entirely be filled with an insulator, for example. Any configuration in which the conductive wires are kept insulated is available.

Also, although the resin-made outer sheath 7 is provided in the above embodiment, the outer sheath 7 may be made of metal. According to this configuration, the cable can be protected reliably. Moreover, in a case in which the outer sheath 7 is made of metal with high magnetic permeability, the outer sheath 7 can function as a magnetic shield, and the magnetic shield 6 can be omitted for cost reduction.

Although the best configuration, method, and the like for carrying out the present invention are disclosed in the above description, the present invention is not limited thereto. That is, although the present invention is mainly illustrated and described based on a specific embodiment, those skilled in the art can modify the aforementioned embodiment in various forms in terms of the shapes, materials, quantities, and other detailed configurations without departing from the technical spirit and objective scope of the present invention.

Accordingly, since the above description disclosed by limiting the shapes, materials, and the like is illustrative only to facilitate understanding of the present invention and does not limit the present invention, description using names of members from which part of limitations of these shapes, materials, and the like or all of the limitations have been removed shall be included in the present invention.

REFERENCE SIGNS LIST

1 Cable
2 First electric wire
3 Second electric wire
4 Insulating cover
6 Magnetic shield
21 First conductive wire
22 First terminal
22*b* First terminal surface
31 Second conductive wire
32 Second terminal
32*b* Second terminal surface

The invention claimed is:

1. A cable, comprising:

a first pair of electrical conductors including a first conductive wire and a second conductive wire;

a second pair of electrical conductors including a third conductive wire and a fourth conductive wire; and a magnetic shield circumscribing the first and second pairs of electrical conductors, wherein the first and the second conductive wires are arranged alternately with respect to the third and fourth conductive wires, and the first, second, third and fourth conductive wires are disposed annularly in a circumferential direction of the cable, an end portion of the first pair of electrical conductors is provided with a first terminal having a first terminal surface parallel to an opposing direction of the first conductive wire and the second conductive wire and an axial direction of the cable, an end portion of the second pair of electrical conductors is provided with a second terminal having a second terminal surface parallel to the first terminal surface, wherein the first conductive wire and the second conductive wire extend in the axial direction and are collectively connected to the first terminal, and the third conductive wire and the fourth conductive wire are bent in a plane parallel to the second terminal surface, extend in the axial direction to avoid interference with the first terminal, and are collectively connected to the second terminal.

2. The cable according to claim 1, wherein a circumference of the first pair of electrical conductors and the second pair of electrical conductors is provided with an insulating cover.

* * * * *